US009038679B2

(12) United States Patent
Marquez-Bottome

(10) Patent No.: US 9,038,679 B2
(45) Date of Patent: May 26, 2015

(54) PROTECTIVE BAG FOR HANDBAG

(76) Inventor: Andrea Marquez-Bottome, New York, NY (US)

( * ) Notice: Subject to any disclaimer, the term of this patent is extended or adjusted under 35 U.S.C. 154(b) by 47 days.

(21) Appl. No.: 13/587,834

(22) Filed: Aug. 16, 2012

(65) Prior Publication Data

US 2014/0048187 A1 Feb. 20, 2014

(51) Int. Cl.
*A45C 3/08* (2006.01)
*A45C 13/00* (2006.01)

(52) U.S. Cl.
CPC ..... *A45C 3/08* (2013.01); *A45C 13/002* (2013.01)

(58) Field of Classification Search
CPC ..... A45C 7/00; A45C 7/068; A45C 7/0063; A45C 3/08; A45C 13/02
USPC ..... 150/103–105, 112, 106; 190/103–105, 190/111, 112; 383/2, 40, 4; D3/234–236, D3/270–271.3, 286
See application file for complete search history.

(56) References Cited

U.S. PATENT DOCUMENTS

| | | | | | |
|---|---|---|---|---|---|
| 1,045,390 | A * | 11/1912 | Goldsmith | 190/103 |
| 1,636,838 | A * | 7/1927 | Roser | 190/103 |
| 2,394,352 | A * | 2/1946 | Zatzkin | 5/205 |
| 2,927,617 | A * | 3/1960 | Kurzrock | 383/2 |
| 3,938,716 | A * | 2/1976 | Jackson et al. | 224/153 |
| 4,096,987 | A * | 6/1978 | Rodish | 383/119 |
| 4,148,347 | A * | 4/1979 | Seaman | 383/2 |
| 4,180,111 | A * | 12/1979 | Davis | 383/2 |
| 4,236,615 | A * | 12/1980 | Ginat | 190/111 |
| 4,773,515 | A * | 9/1988 | Kotkins, Jr. | 190/103 |
| 4,846,319 | A * | 7/1989 | Sadow | 190/105 |
| 5,472,082 | A * | 12/1995 | Thiele | 206/284 |
| 5,704,528 | A * | 1/1998 | Faure | 224/583 |
| 5,988,878 | A * | 11/1999 | Simonett et al. | 383/2 |
| 7,073,942 | B2 * | 7/2006 | Vazquez | 383/2 |
| 7,093,699 | B2 | 8/2006 | Yu | |
| 7,293,635 | B2 * | 11/2007 | Repke et al. | 190/109 |
| 7,814,948 | B2 | 10/2010 | Amante | |
| 7,874,409 | B1 * | 1/2011 | Lakhal | 190/105 |
| 2003/0000612 | A1 * | 1/2003 | Sutton | 150/105 |
| 2004/0262111 | A1 * | 12/2004 | Ghiassi | 190/103 |
| 2005/0205178 | A1 * | 9/2005 | Wynona | 150/105 |
| 2006/0102673 | A1 * | 5/2006 | Collier | 224/581 |
| 2006/0144487 | A1 | 7/2006 | Bockey | |
| 2010/0032065 | A1 | 2/2010 | Kelly | |
| 2010/0270115 | A1 | 10/2010 | Seamon | |
| 2010/0282379 | A1 | 11/2010 | Piper | |
| 2011/0005646 | A1 * | 1/2011 | Nelson | 150/103 |
| 2013/0087423 | A1 * | 4/2013 | Bettua et al. | 190/105 |

* cited by examiner

*Primary Examiner* — Sue A Weaver
(74) *Attorney, Agent, or Firm* — Brenda Pomerance

(57) ABSTRACT

A protective bag, such as for a handbag, has configurable dimensions so that the protective bag can be conformed to the shape and size of the handbag. The width, depth, height and silhouette of the protective bag can be separately configured. The protective bag may have a rim that can be independently configured. Accessory pockets and removable carriers such as a shoulder strap or a pair of handles may be part of the protective bag.

18 Claims, 9 Drawing Sheets

Fig. 1A (Prior Art)
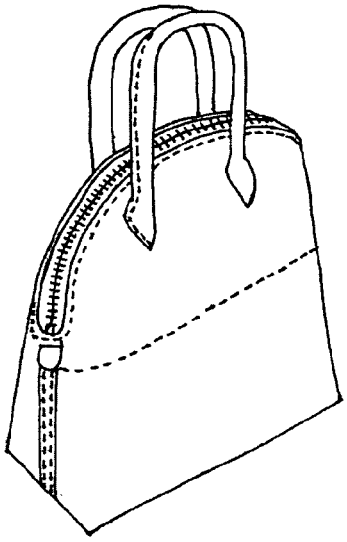
Fig. 1B (Prior Art)
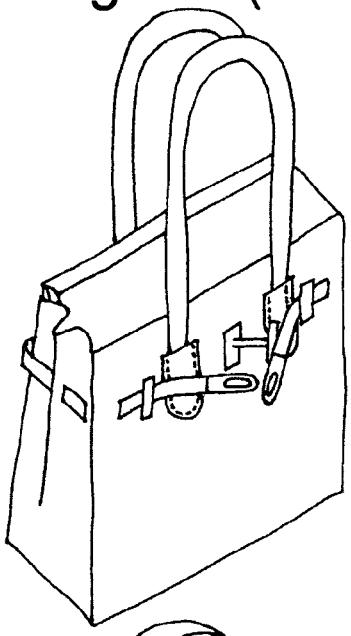
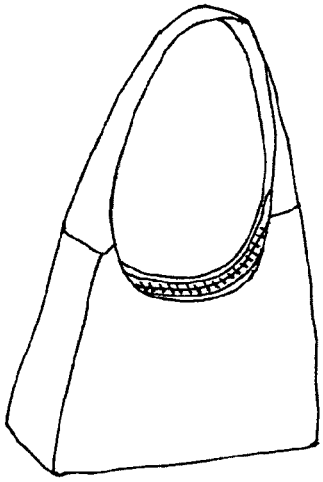
Fig. 1C (Prior Art)
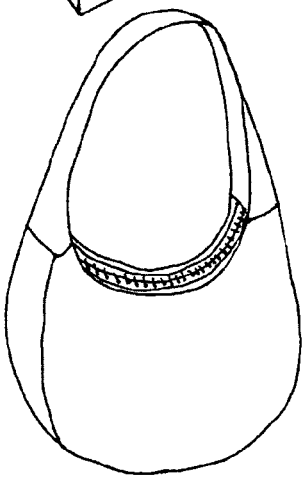
Fig. 1D (Prior Art)

PROTECTIVE BAG FOR HANDBAG

BACKGROUND OF THE INVENTION

The present invention relates to a protective bag, and more particularly, is directed to a protective bag for a handbag, the protective bag having reconfigurable dimensions.

A handbag, as used herein, refers to a purse or briefcase carried by hand or over the shoulder. Handbags are extremely popular and are available in many shapes and sizes. Typical sizes range from 6 inch width×3 inch height×1 inch depth, to 20 inch width×16 inch height×8 inch depth.

FIGS. 1A-1D show typical styles of handbags. FIG. 1A shows a "bolide" bag, FIG. 1B shows a "birkin" bag, FIG. 1C shows a trapezoidal "hobo" bag, and FIG. 1D shows a U-shaped hobo bag.

Handbags can be made of one or more of cloth, plastic, nylon, leather, exotic animal skin, or combinations thereof. Many of these materials are susceptible to water stains from precipitation such as snow or rain, water damage such as corrosion of interior cardboard or other stiffening elements, and sun damage. Accordingly, it is desirable to have a protective cover that can be used, e.g., during inclement weather.

Protective covers for handbags have been proposed.

U.S. Pat. No. 7,814,948 (Amante) shows a waterproof protective cover for protecting a handbag, purse, knapsack, or other handheld carrying container from the elements. Amante discloses one or more eleastic bands (element 12) encircling the circumference of the bag. The elastic bands are described as creating closure around the bag in order to protect it from the elements. Amante further shows a pliable trim piece (element 13) that can be made of wire material that is contracted around the top of the handbag. Amante contemplates either a disposable single use handbag protector or a reusable protector (column 3, lines 11-14).

U.S. Published Patent Application No. 2006/0144487 (Bockey) shows a waterproof protective handbag cover for use in protecting a handbag, purse, knapsack, or other handheld carrying container from the elements. The invention includes protective panels and slots on the sides for the handbag straps. Bockey discloses a plurality of panels, and the front panel is described as being expandable [0020], though it is not explicitly stated that the expandable nature of the front panel is to allow for the protection and form fitting of multiple sizes of handbags. Bockey notes that her design can be customized for non-rectangular shapes [0015], but does not explain how, implying that the construction would be fixed as shown for the rectangular shape.

U.S. Published Patent Application No. 2010/0282379 (Piper) shows a waterproof protective handbag cover that collapses into a small pouch to be attached to the handbag when not in use. Piper discloses an elastic or drawstring (element 102) that is used to close the opening at the top of the protective cover and secure the protective cover to the handbag. Besides this description of the cover being secured to the handbag, there are no other features directed towards any form fitting aspect of the invention. Instead, the invention is directed towards the pouch being collapsable and easily stored and attached to the handbag when not in use.

U.S. Pat. No. 7,093,699 (Yu) shows a protective cover designed to protect luggage from exposure to the elements and wear and tear, that can accommodate expandable luggage in multiple configurations. Yu discloses a circumferential fastening apparatus, such as a zipper (element 500), that in its unexpanded state, encloses an expandable material (elements 550 or 750) to allow the cover to tightly enclose a piece of luggage in either its expanded or unexpanded state. Yu does not specifically disclose the use of the cover for tightly enclosing different pieces or sizes of luggage.

U.S. Published Patent Application No. 2010/0270115 (Seamon) shows a protective cover designed to protect luggage from dirt and abuse. The invention is directed towards a form fitting and expandable luggage cover that can accommodate luggage of different thicknesses and depths. The reference discloses a resilient material that stretches around a pieces of luggage of differing size.

U.S. Published Patent Application No. 2010/0032065 (Kelly) shows a "Ducky" cover that protects handbags from weather and stains which could diminish the appearance or longevity of the product. The cover includes a strap encasement that can be used to protect a wide variety of handbag straps (paragraph 29). Kelly states that the Ducky may be customized as need to provide protection to a variety of shapes of handbags ([0019], [0023]). Kelly states that the cover may utilize adjustable components to accommodate various styles of handbags, but the only adjustable component disclosed is the adjustable strap encasement.

There is room for improvement in the area of handbag protectors, particularly protectors for non-rectangular bags.

SUMMARY OF THE INVENTION

In accordance with an aspect of this invention, there is provided a bag having a height, a width and a depth, comprising a front panel, a back panel, a left panel, a right panel, and a base panel. Each of the front, back, left, right and base panels has four edges and is configurable in two dimensions. An edge of each of the front panel and the back panel is connected to an edge of each of the left panel and right panel. An edge of the base panel is respectively connected to an edge of each of the front, back, left and right panels. Accordingly, each of the height, width and depth of the bag can be independently configured by configuring appropriate dimensions of the front, back, left, right and base panels.

In accordance with another aspect of this invention, there is provided a bag having a height, a width and a depth, comprising a front panel, a back panel connected to the front panel, a base panel connected to each of the front panel and the back panel, and a rim having a perimeter extending along the top of each of the front and back panels, the length of the rim being configurable. Each of the front and back panels is configurable in at least one dimension, whereby at least one of the height and width of the bag can be configured by configuring the dimensions of the front and back panels.

In accordance with a further aspect of this invention, there is provided a bag, comprising a front panel having two side edges, a top edge and a bottom edge; a back panel having two side edges, a top edge and a bottom edge; a base panel connected to the bottom edge of each of the front panel and the back panel; a first extension pocket connected to one side of each of the front panel and the back panel; a second extension pocket connected to the other side of each of the front panel and the back panel. The two side edges of the front panel are respectively connected to the two side edges of the back panel such that portions of the connections are adjustable between a first state and a second state, the first state in which the silhouette of the bag is determined by the side edges of the front and back panels, the second state in which the silhouette of the bag is determined by the first and second extension pockets.

In a further aspect of the invention, each of the front and back panels has at least one configurable dimension, enabling the size of the bag to be changed.

It is not intended that the invention be summarized here in its entirety. Rather, further features, aspects and advantages of the invention are set forth in or are apparent from the following description and drawings.

BRIEF DESCRIPTION OF THE DRAWINGS

FIGS. 1A-1D are diagrams of different types of conventional handbags;

DETAILED DESCRIPTION

A problem with conventional handbag protectors is that they have generally fixed dimensions. If the dimensions of the protector are too small, it is unusable. If the dimensions of the protector are too big, the protector has a sloppy fit, so instead of looking stylish, the user of the handbag merely looks like she is carrying a shopping bag. Further, if the protector is much larger than the handbag, the user may need to fumble about to retrieve something from her handbag.

A handbag protector according to the present invention has configurable dimensions, enabling the protector to fit appropriately for a wide range of handbag sizes, and to enable extra room when the user wishes to protect something additional such as a book or an electronic device. The length, width, depth and silhouette of the protector are configurable by the user. The size of the top opening is configurable, and may have its own protective top flap. The protector is usable with a variety of handles and shoulder straps. Accessories may be added, including interior and exterior pockets, protectors for the straps or handles of the handbag, separate compartments and so on. Generally, the protector is made of a waterproof, lightweight material, so it can be folded or rolled to a small size when not in use. In some cases, the protector is re-usable, while in other cases, it is intended for single use. The protector also serves as a dustbag, and prevents fading due to light exposure.

Figure 2:
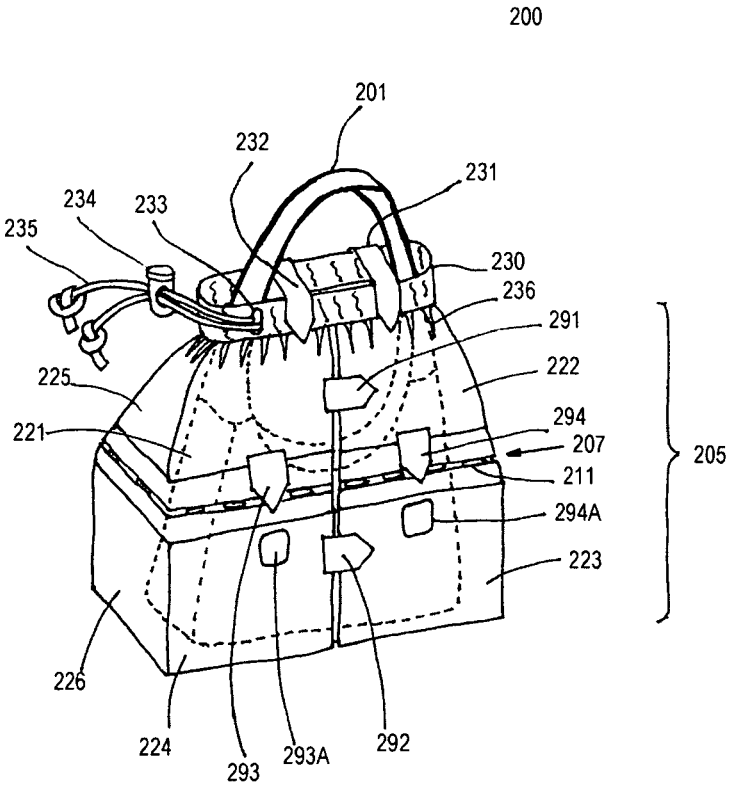
FIG. 2 is a three-dimensional view of a protective bag according to the present invention.

FIG. 2 is a three-dimensional view of protective bag 200 according to the present invention. The embodiment of FIG. 2 shows protective bag 200 enclosing a conventional trapezoidal hobo handbag (dotted lines), with handle 201 of the hobo handbag usable for carrying the hobo handbag and protector bag 200.

Protective bag 200 is made out of a fabric-like material, preferably waterproof urethane-coated nylon oxford, such as ULTREX® 3-ply, available at www.seattlefabrics.com. In other cases, protective bag 200 may be made out of coated nylon, coated rayon, coated cotton, coated paper, TYVEK® spun high-density polyethylene fibers, NEOPRENE®, GORE-TEX®, WINDSTOPPER®, PVC, wax derivative products, plastic, water resistant material and so on.

Protective bag 200 has a configurable width, a configurable height, and a configurable top opening.

Protecive bag 200 has top welt 230 attached to main portion 205. Top welt 230 serves to enclose drawstring 235, and has opening 233 for exposing the ends of drawstring 235. Cordlock 234 is a conventional cordlock having a cylindrical shape with a hole for enabling the ends of drawstring 235 to pass therethrough, and an endplate that can be depressed to push an enclosed spring (not shown), allowing drawstring 235 to travel therethrough. When the endplate is not depressed, the ends of drawstring 235 are immobilized, so that they do not disappear into welt 230. Straps 231, 232 are shown disposed across the top of the opening of protective bag 200. Each of straps 231, 232 encloses a magnet that is attracted to a respective one of two magnets (not shown) enclosed in welt 230, so that respective ends of straps 231, 232 are removable.

The ends of drawstring 235 can be pulled out of opening 233 to reduce the size of the top opening of protective bag 200. To increase the size of the top opening of protective bag 200, the user pulls welt 230 to its fully opened size. For instance, to properly protect a bolide handbag, shown in FIG. 1A, the top opening of protective bag 200 should be substantially narrowed, whereas to properly protect a birkin handbag, shown in FIG. 1B, the top opening of protective bag 200 should be only slightly narrowed.

In some cases, instead of drawstring 235, welt 230 encloses a loop of elastic so that the opening of protective bag 200 can stretch from its smallest resting size to larger sizes.

Thus, the top opening of protective bag 200 is configurable.

Main portion 205 of protective bag 200 has a front side with top left piece 221, top right piece 222, bottom right piece 223 and bottom left piece 224. Main portion 205 has a back side (not shown) similar to its front side. Main portion has a left side panel with top pice 225 and bottom piece 226. Main portion has a right side panel (not shown) similar to its left side panel. Main portion 205 also has a bottom side (not shown) with a left piece and a right piece.

Straps 293 and 294 each have, on their underside (not shown), a rectangular piece of loop fasteners for respectively mating with hook fastener pieces 293A, 294A.

One end of strap 293 is permanently connected to top left piece 221. Hook fastener piece 293A is permanently connected to bottom left piece 224. When strap 293 mates with hook fastener piece 293A, the bottom edge of top left piece 221 abuts the top edge of bottom left piece 224. When strap 293 and hook fastener piece are un-mated, pleat 207 is exposed. Instead of hook and loop fasteners, such as Velcro, any other two-part mating fasteners may be used, such as a snap having male and female portions, or two magnets, or a buckle for receiving an end of strap 293. Although only one strap 293 is shown on top left piece 221, a plurality may be provided.

One end of strap 294 is permanently connected to top right piece 222. Hook fastener piece 294A is permanently connected to bottom right piece 223. Strap 294 and hook fastener piece 294A operate in similar manner as strap 293 and hook fastener piece 293A, and, for brevity, will not be discussed.

When both straps 293, 294 are mated with respective hook fastener pieces 293A, 294A, protective bag 200 has a first height. When both are unmated (and the corresponding straps on the back side of protective bag 200 are also unmated), then protective bag 200 has a second height that is greater than its first height, by the height of pleat 207.

Pleat 207 is seen to have a top portion and a bottom portion connected by snaps 211. As discussed in detail with regard to FIGS. 3A-3B, this arrangement provides for a first height of pleat 207 when snaps 211 are closed, and a second height of pleat 207 when snaps 211 are open.

Thus, the height of protective bag 200 is reversibly configurable between a first height when straps 293, 294 are mated, a second height when straps 293, 294 are un-mated and snaps 211 are closed, and a third height when straps 293, 294 are un-mated and snaps 211 are open.

Straps 291 and 292 each have, on their underside (not shown), a rectangular piece of loop fasteners for respectively mating with hook fastener pieces 291A, 292A (not shown).

One end of strap 291 is permanently connected to top left piece 221. Hook fastener piece 291A is permanently connected to top right piece 222. One end of strap 292 is permanently connected to bottom left piece 224. Hook fastener piece 292A is permanently connected to bottom right piece 223.

Strap 291, 292 operate in similar manner as straps 293, 294 and, for brevity, will not be discussed. Protective bag 200 has a first width when straps 291, 292 are mated, and a second width when straps 291, 292 are un-mated, along with corresponding straps on the back side and the bottom side of protective bag 200 (not shown), exposing respective pleats.

Thus, the width of protective bag 200 is configurable.

Figure 3A:
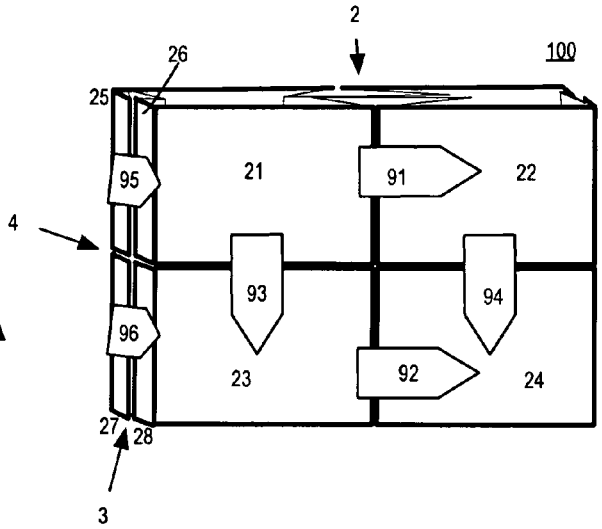
FIGS. 3A-3C are views of a portion of a protective bag according to the present invention illustrating its configurable dimensions.
Figure 3B:
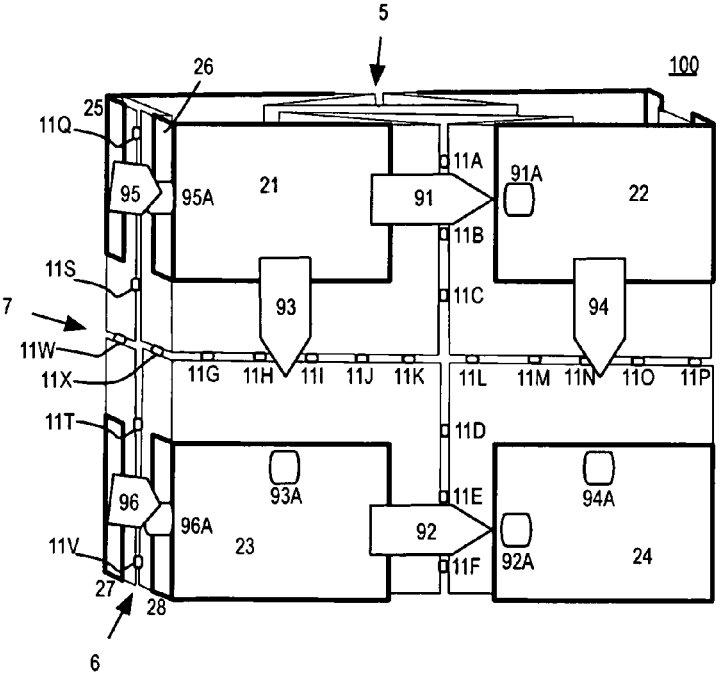
Figure 3C:
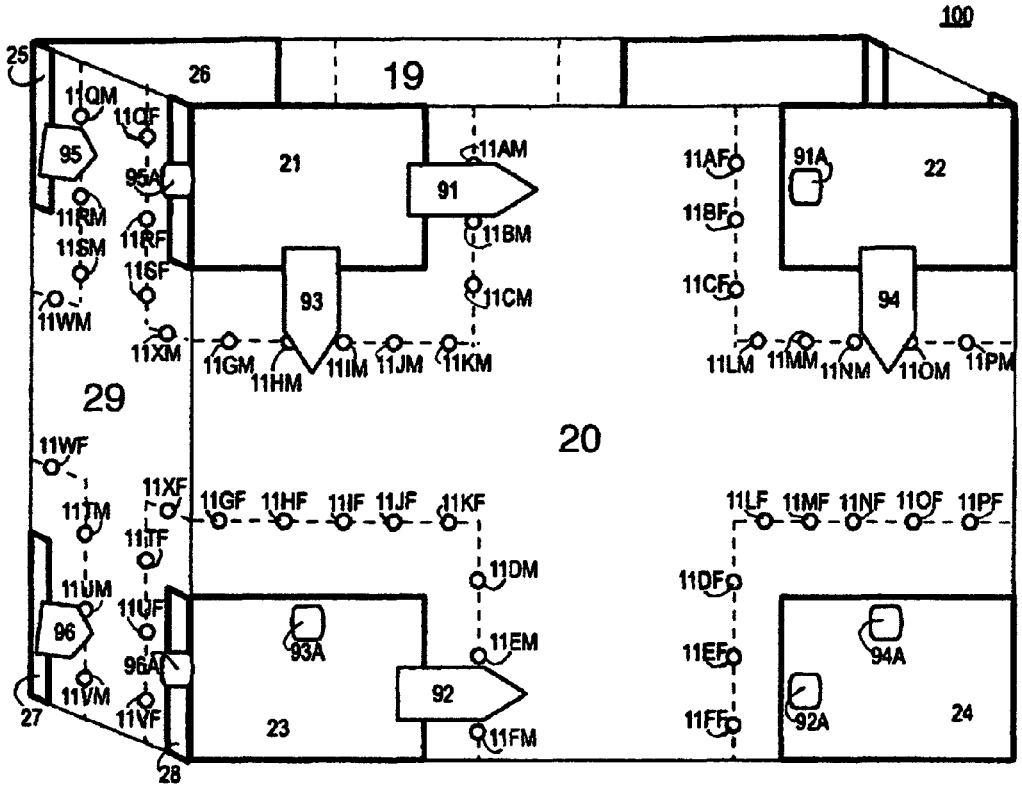

FIGS. 3A-3C are views of main portion 100 of protective bag according to the present invention illustrating its configurable dimensions. Generally, a welt with a drawstring closure is attached to the top opening of main portion 100 to create the protective bag. In other cases, handles or a shoulder strap may be attached. In other cases, a flap serving as a cover may be attached to create the protective bag from main portion 100.

Main portion 100 has three configurable dimensions: width, height and depth. Each of the dimensions can be configured to one of three sizes. In other variations, the dimensions can be configured to one of two sizes, one of three sizes and so on. FIG. 3A shows main portion 100 with each dimension in its smallest size, FIG. 3B shows main portion 100 with each dimension in its middle size, and FIG. 3C shows main portion 100 with each dimension in its largest size. Table 1 shows the size range for main portion 100. In other embodiments, different sizes may be used.

TABLE 1

| | Handbag size | | | Protective bag size | | |
|---|---|---|---|---|---|---|
| | Width | Depth | Height | Width | Depth | Height |
| Small | 8" | 10" | 1" | 10" | 12" | 2" |
| Medium | 10" | 14" | 2" | 12" | 17" | 4" |
| Large | 15" | 18" | 6" | 18" | 21" | 9" |

Turning to FIG. 3C, main portion 100 is shown in its fully extended state. Main portion 100 has front panel 20 with top left piece 21, top right piece 22, bottom left piece 23 and bottom right piece 24 disposed in its corners. Main portion 100 has back panel 19 and a bottom panel (not shown) similar to front panel 20. Main portion 100 has left panel 29 with top left piece 25, top right piece 26, bottom left piece 27 and bottom right piece 28 disposed in its corners. Main portion 100 has a right panel (not shown) similar to left panel 29. For clarity, these pieces are shown in bold outlining, but in practice, they made be made of the same material as the rest of main portion 100.

Dotted lines in FIG. 3C show the outlines of four phantom pieces on each side of main portion 100. These phantom pieces are larger than the pieces shown in bold outlining, and are respectively aligned along one corner and two sides. In some cases, the phantom pieces made be made of different material than the rest of main portion 100, and so they would not be phantom. Along the interior edges of the phantom pieces are disposed one part of two-part connectors. These connectors mate with the other part of the two-part connectors on the opposite interior edge of the phantom piece to change the respective dimension of main part 100 from its third value to its second value, i.e., from large to medium.

Specifically, to reduce the width of main portion 100, on the front of main portion 100, male snap parts 11AM, 11BM, 11CM, shown in FIG. 3C, disposed along the right interior phantom edge to the right of upper left piece 21 mate with female snap parts 11AF, 11BF, 11CF disposed along the left interior phantom edge to the left of upper right piece 22, and male snap parts 11DM, 11EM, 11FM disposed along the right interior phantom edge to the right of bottom left piece 23 mate with female snap parts 11DF, 11EF, 11FF disposed along the left interior phantom edge to the left of bottom right piece 24; and corresponding parts on the back and bottom of main portion 100 mate. When the mating occurs, first vertical pleat 5 (see FIG. 3B) is formed, and the width of main portion 100 is reduce from a first width to a second width.

To reduce the height of main portion 100, on the front of main portion 100, male snap parts 11GM, 11HM, 11IM, 11JM, 11KM, shown in FIG. 3C, disposed along the bottom interior phantom edge to the bottom of upper left piece 21 mate with female snap parts 11GF, 11HF, 11IF, 11JF, 11KF disposed along the top interior phantom edge to the top of bottom left piece 23, and male snap parts 11LM, 11MM, 11NM, 11OM, 11PM disposed along the bottom interior phantom edge to the bottom of top right piece 23 mate with female snap parts 11LF, 11MF, 11NF, 11OF, 11PF disposed along the top interior phantom edge to the top of bottom right piece 24; when the mating occurs, first horizontal pleat 7 (see FIG. 3B) is formed, and the height of main portion 100 is reduced from a first height to a second height.On the left side of main portion 100, male snap part 11WM disposed along the bottom interior phantom edge to the bottom of upper left piece 25 mates with female snap parts 11WF disposed along the top interior phantom edge to the top of bottom left piece 27, and male snap part 11XM disposed along the bottom interior phantom edge to the bottom of top right piece 26 mates with female snap part 11XF disposed along the top interior phantom edge to the top of bottom right piece 28; and corresponding parts on the back and right sides of main portion 100 mate.

To reduce the depth of main portion 100, on the left side of main portion 100, male snap parts 11QM, 11RM, 11SM, shown in FIG. 3C, disposed along the right interior phantom edge to the right of upper left piece 25 mate with female snap parts 11QF, 11RF, 11SF disposed along the left interior phantom edge to the left of upper right piece 26, and male snap parts 11TM, 11UM, 11VM disposed along the right interior phantom edge to the right of bottom left piece 27 mate with female snap parts 11TF, 11UF, 11VF disposed along the left interior phantom edge to the left of bottom right piece 28; and corresponding parts on the right and bottom side of main portion 100 mate. When the mating occurs, first depth pleat 5 (see FIG. 3B) is formed, and the depth of main portion 100 is reduced from a first depth to a second depth.

FIG. 3C shows, on the front side, three snaps along the phantom edge used for width adjustment and five snaps along the phantom edge used for height adjustment, and on the left side, three snaps along the phantom edge used for depth adjustment and one snap along the phantom edge used for height adjustment. The number of snaps may be varied. Instead of snaps, other two part connectors may be used such as hook and loop fasteners, fully detachable zippers, magnets, laces, buttons and buttonholes, Ziploc™ plastic strips, and so on.

After the snaps are mated as described above, to reduce the height, width and depth of main portion 100, main portion 100 is as shown in FIG. 3B. The height reduction has formed pleat 7, the width reduction has formed pleat 5, and the depth reduction has formed pleat 6. The edges of mated snaps 11A-11X are shown in FIG. 3B.

On the front side of main portion 100, top left piece 21 has straps 91, 93. One end of strap 91 is affixed to the right edge of top left piece 21. The underside of strap 91 has a rectangular patch of hook fasteners (not shown). One end of strap 93 is affixed to the bottom edge of top left piece 21. The underside of strap 93 has a rectangular patch of hook fasteners (not shown).

Top right piece 22 has a rectangular patch of loop fasteners 91A along its left edge, for mating with the hook fasteners on the underside of strap 91, and strap 94. One end of strap 94 is affixed to the bottom edge of top right piece 22. The underside of strap 94 has a rectangular patch of hook fasteners (not shown).

Bottom left piece 23 has a rectangular patch of loop fasteners 93A along its top edge, for mating with the hook fasteners on the underside of strap 93, and strap 92. One end of strap 92 is affixed to the right edge of bottom left piece 23. The underside of strap 92 has a rectangular patch of hook fasteners (not shown).

Bottom right piece 24 has a rectangular patch of loop fasteners 92A along its left edge, for mating with the hook fasteners on the underside of strap 92, and has a rectangular patch of loop fasteners 94A along its top edge, for mating with the hook fasteners on the underside of strap 94.

On the left side of main portion 100, top left piece 25 has strap 95. One end of strap 95 is affixed to the right edge of top left piece 25. The underside of strap 95 has a rectangular patch of hook fasteners (not shown).

Top right piece 26 has a rectangular patch of loop fasteners 95A along its left edge, for mating with the hook fasteners on the underside of strap 95.

Bottom left piece 27 has strap 96. One end of strap 96 is affixed to the right edge of bottom left piece 27. The underside of strap 96 has a rectangular patch of hook fasteners (not shown).

Bottom right piece 28 has a rectangular patch of loop fasteners 96A along its left edge, for mating with the hook fasteners on the underside of strap 96.

To further reduce the width of main portion 100, strap 91, shown in FIG. 3B, is mated with loop fasteners 91A and strap 92 is mated with loop fasteners 92A, and corresponding parts on the back and bottom of main portion 100 mate. When the mating occurs, second vertical pleat 2 (see FIG. 3A) is formed, and the width of main portion 100 is reduced from the second width to a third width.

To further reduce the height of main portion 100, strap 93, shown in FIG. 3B, is mated with loop fasteners 93A and strap 94 is mated with loop fasteners 94A. When the mating occurs, second horizontal pleat 4 (see FIG. 3A )is formed, and the height of main potion 100 is reduced from the second height to a third height.

To further reduce the depth of main portion 100, strap 95, shown in FIG. 3B, is mated with loop fasteners 95A and strap 96 is mated with loop fasteners 96A, and corresponding parts on the right and bottom side of main portion 100 mate. When the mating occurs, second depth pleat 3 (see FIG. 3A) is formed, and the depth of main portion 100 is reduced from the second depth to a third depth.

After the straps are mated as described above, to reduce the height, width and depth of main portion 100, main portion 100 is as shown in FIG. 3A. The height reduction has formed pleat 4, the width reduction has formed pleat 2, and the depth reduction has formed pleat 3.

The sizes of pleats 2, 3, 4, 5, 6, 7 can be varied independently.

The types of connectors used can be varied.

Figure 4A:
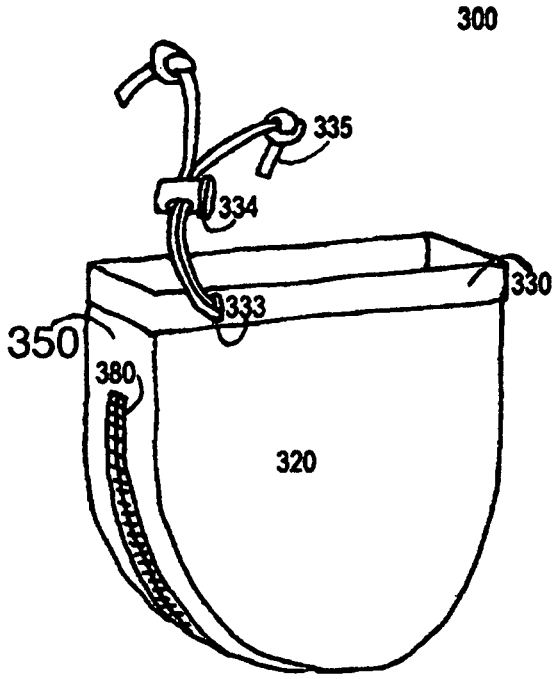
FIGS. 4A-4D are three-dimensional views of another protective bag according to the present invention.
Figure 4B:
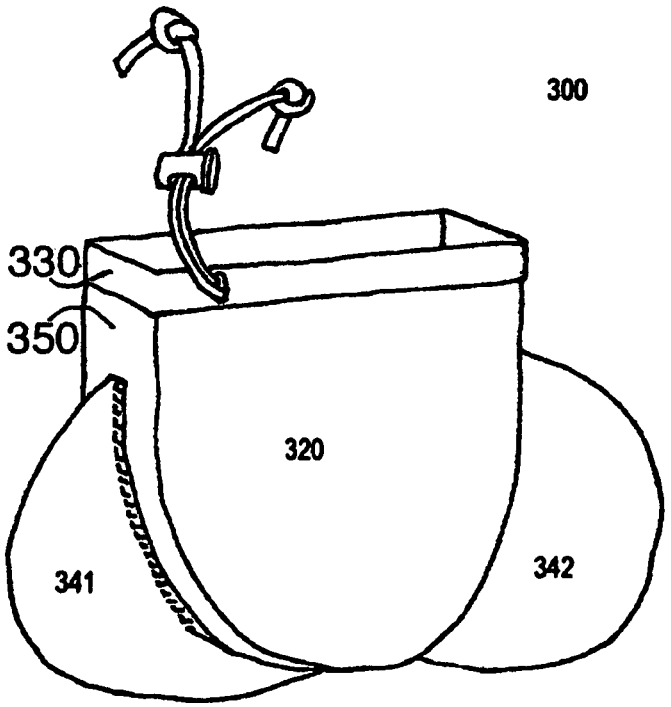

FIGS. 4A-4B are three-dimensional views of protective bag 300, which has a configurable silhouette. In other embodiments, protective bag 300 also has configurable width, height and depth, as described above with regard to FIGS. 3A-3C.

Returning to FIGS. 1C and 1D, it will be seen that the popular hobo handbag can have a silhouette in which the bottom is the widest portion, as shown in FIG. 1C, or in which the width along the bottom is narrower than the width at an intermediate height, as shown in FIG. 1D.

FIG. 4A shows protective bag 300 configured to receive the U-shaped hobo handbag shown in FIG. 1D. Protective bag 300 has front panel 320 and a similar back panel (not shown), each of which has a top edge and a U-shaped edge. Protective bag 300 has depth panel 350 having a rectangular shape. Opposing long edges of depth panel 350 are connected to the U-shaped edges of the front and back panels. The top edges of the front and back panels and the short edges of depth panel 350 form a rim at the top of protective bag 300.

Welt 330 is attached to the rim formed by the top edges of the front, back and depth panels of protective bag 300. Welt 330 encloses drawstring 335, and has opening 333 for drawstring 335. Cordlock 334 immobilizes the ends of drawstring 335. Welt 330 operates similarly as welt 230, discussed above.

Zipper 380 is positioned along the left side of depth panel 350. Another zipper (not shown) is positioned along the right side of depth panel 350. Both zippers are closed, creating a U-shaped silhouette for protective bag 300 that generally conforms to the U-shape of a U-shaped hobo handbag. The U-shaped silhouette is a first state of protective bag 300.

FIG. 4B shows protective bag 300 configured to receive the trapezoidal hobo handbag shown in FIG. 1C. The zippers along the left and right sides are opened, and extension pockets 341, 342 are respectively pulled out through the openings in the left and right sides, creating a space that generally conforms to the trapezoidal shape of a trapezoidal hobo handbag and changing the silhouette of protective bag 300. The extended silhouette is a second state of protective bag 300.

Figure 4C:
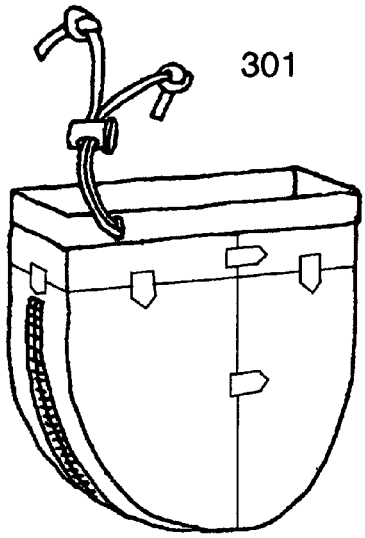
Figure 4D:
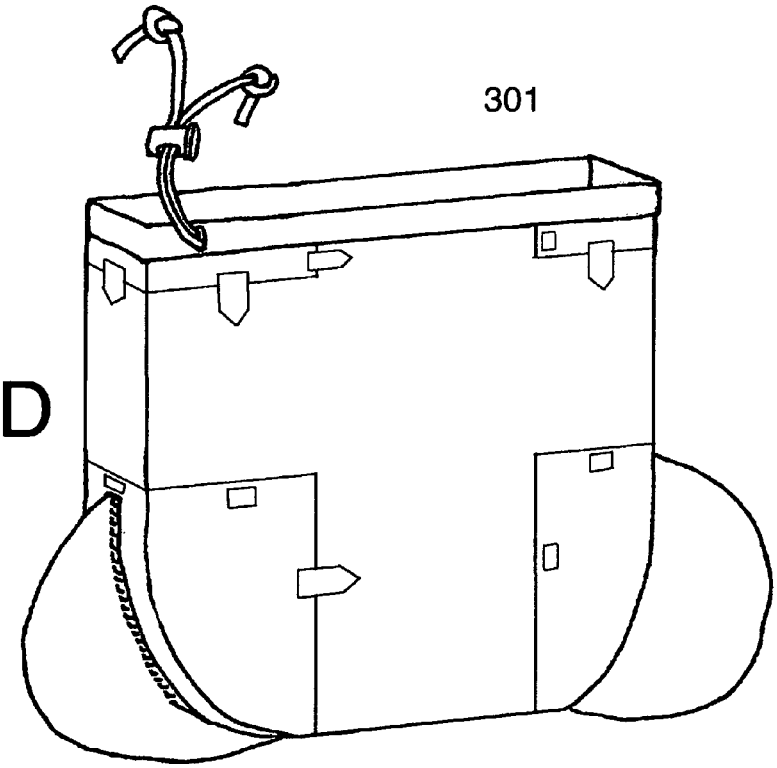

FIGS. 4C-4D shows protective bag 301 which is similar to protective bag 300 but also include configurable dimensions as in the protective bag of FIGS. 3A and 3B. FIG. 4C shows connector closed for a small size bag, while FIG. 4D shows connectors open for a large size bag.

Figure 5:
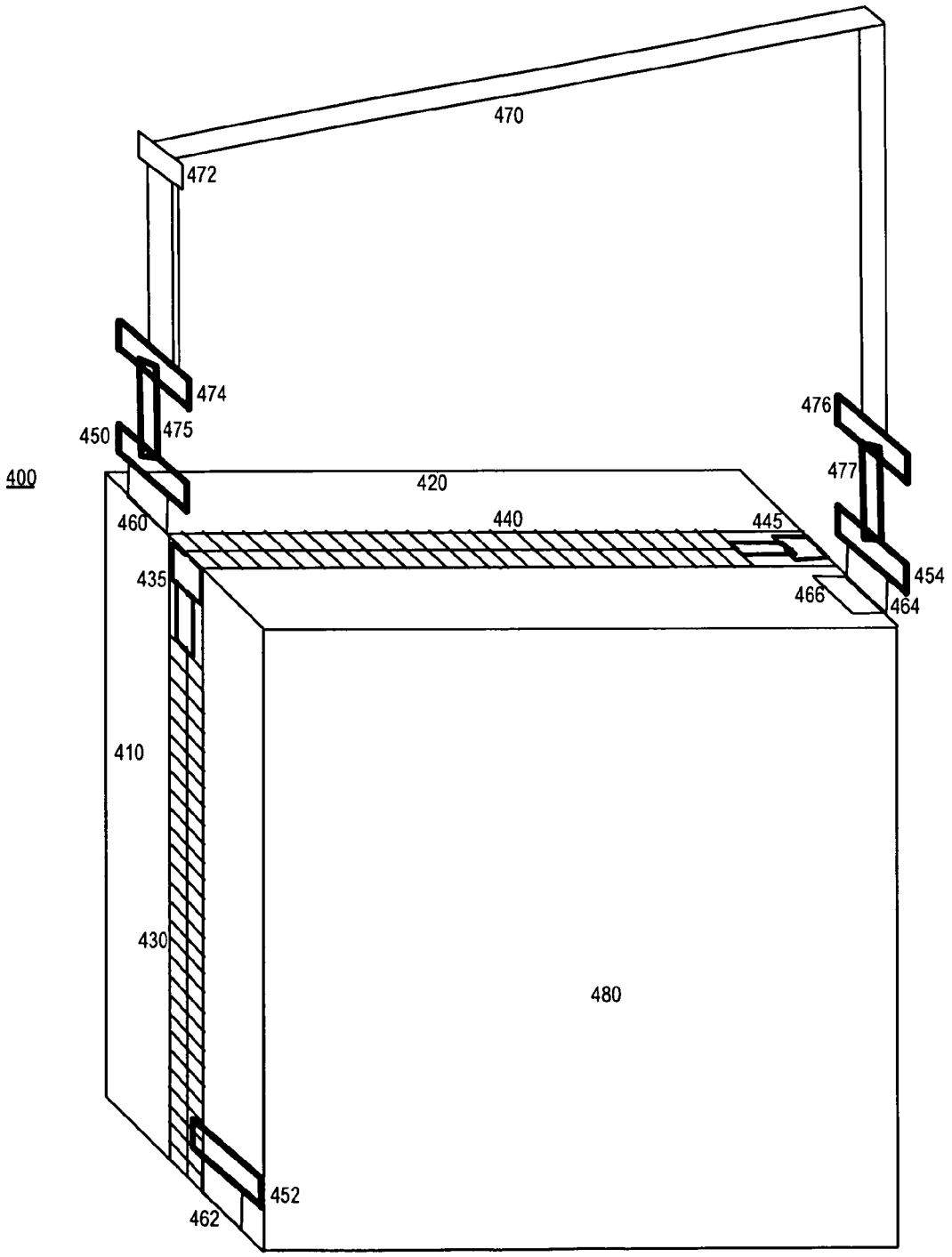
FIG. 5 is a three-dimensional view of a further bag according to the present invention.

FIG. 5 shows protective bag 400, which can be easily converted from "portrait" to "landscape" orientations. As used herein and in the claims, "portrait" means an orientation in which the width is less than the height, while "landscape" means an orientation in which the height is less than the width. In other embodiments, protective bag 400 also has configurable width, height and depth, as described above with regard to FIGS. 3A-3C.

Protective bag 400 has long side 410, short side 420 and front side 480. Long side 410 has central closure 430, herein a zipper with slider 435. Short side 420 has central closure 440, herein a zipper with slider 445. Long side 410 has flaps 460 and 462 located at opposite ends thereof. Short side 420 has flaps 460 and 464 located at opposite ends thereof. Flaps 460, 462, 464 respectively anchor rectangular rings 450, 452, 454. Short side 420 has affixed thereto fastener 466, which mates with flap 464. Long side 410 has affixed thereto a similar fastener (not shown), which mates with flap 462.

Shoulder strap 470 has a length that is adjustable by sliding adjuster 472. Rings 474 and 476 are fastened to respective ends of shoulder strap 470. Removable ring 475 is attached to ring 474 and rectangular ring 450. Removable ring 477 is attached to ring 476 and rectangular ring 454. Removable rings 475, 477 may be of the hinged carabiner type, or ampersand (&) shaped type with a flexible arm that can be pushed open to enable removability, or other suitable construction.

In embodiments wherein the width and/or height are configurable, instead of a zipper, a row of snaps or buttons, or strips of VELCRO, or other suitable fastener composed of discrete elements, is used.

FIG. 5 shows protective bag 400 in portrait orientation. To use, zipper 440 is opened, the handbag is placed inside, and zipper 440 is closed.

To convert protective bag 400 to landscape orientation, removable ring 477 is removed from rectangular ring 454, flap 464 is mated with fastener 466, flap 462 is removed from its faster (not shown), and removable ring 477 is attached to rectangular ring 452. To use, zipper 430 is opened, the handbag is placed inside, and zipper 430 is closed.

Figure 6:
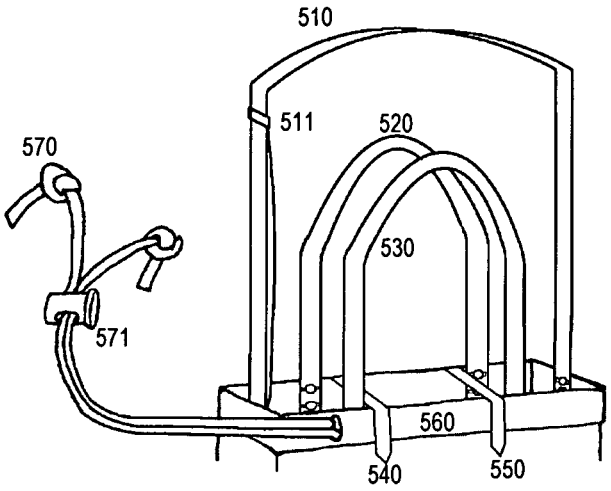
FIG. 6 is a view of a top portion of a protective bag according to the present invention.

FIG. 6 is a view of a top portion of a protective bag. Top welt 560, drawstring 570, cordlock 571 and straps 540, 550 are similar to corresponding elements of FIG. 2, operate in similar manner, and will not be discussed here for brevity.

The inside of top welt 560 has buttons affixed thereto. Instead of buttons, metal projections may be affixed to the inside of top welt 560.

Shoulder strap 510 has a length that may be varied by adjusting adjuster 511. The ends of shoulder strap 510 have buttonholes or appropriate slits so that the shoulder strap ends may be removably fastened to the buttons on opposite sides of the inside of top welt 560.

Handle 520 has ends with buttonholes or appropriate slits so that the ends of handle 520 may be removably fastened to the buttons on one side of the inside of top welt 560.

Handle 530 is similar to handle 520, and is removably fastened to the side of the inside of top welt 560 that is opposite the side to which handle 520 is fastened. Handles 520 and 530 function together as "shopping bag" type handles for the protective bag.

Figure 7:
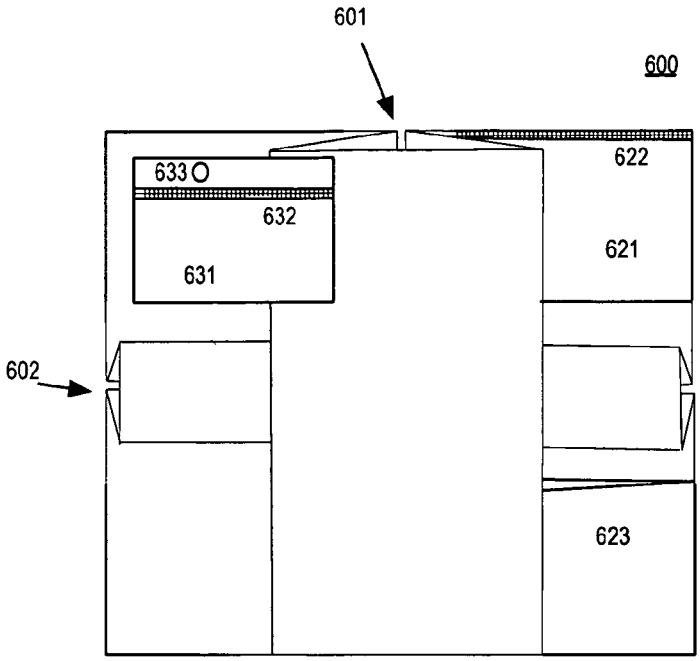
FIGS. 7 and 8 are interior views of a protective bag according to the present invention.
Figure 8:
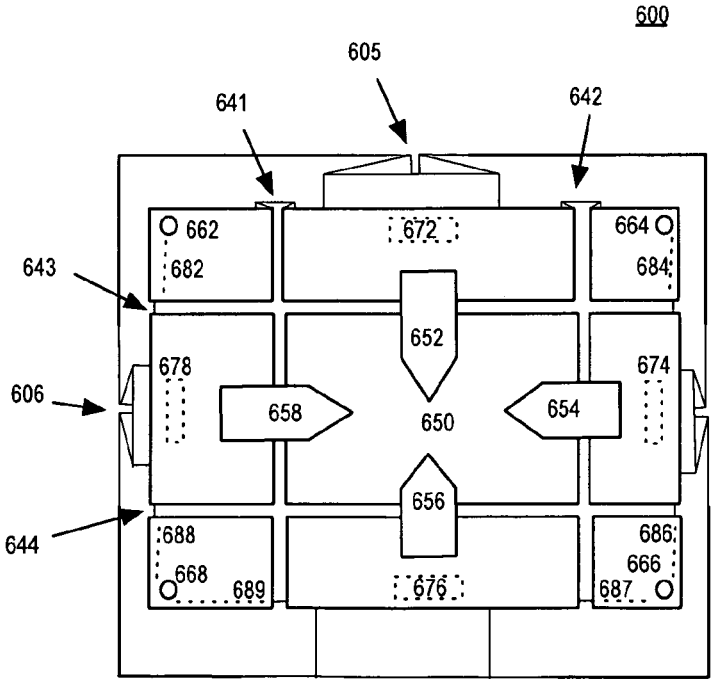

FIGS. 7 and 8 are views of protective bag 600, showing opposite sides of protective bag 600 with different types of accessory pockets. In this embodiment, the pockets are on the inside of protective bag 600. In other embodiments, the pockets may be on the outside, or some pockets may be on the inside and some pockets may be on the outside.

FIG. 7 shows three types of fixed-size pockets. Width pleat 601 of protective bag 600 is shown in closed form. Height pleat 602 of protective bag 600 is shown in closed form.

Pocket 623 is in the lower right corner, and has an open top with three sides fastened to protective bag 600. As can be seen in FIGS. 3A-3C, the corners of protective bag 100 are invariant (undeformed) when protective bag 100 is configured to different sizes. Accordingly, if protective bag 600 is approximately the size of protective bag 100, pocket 623 can approximately the size of, e.g., bottom left piece 23 of bag 100.

Pocket 621 is in the upper right corner, and is similar to pocket 623 except that it has closure 622 along its top edge, shown as a zipper. In other embodiments, closure 622 may be an envelope-style flap, buttons, snaps, velcro or other reclosable closure.

Whereas the side of protective bag 600 forms one side of each of pockets 621, 623, pocket 631 is an independent enclosure attached by snap 633 to protective bag 600. Accordingly, pocket 631 can serve as a wallet, or wallet protector, or holder for small items such as small electronic devices, keys and the like. Pocket 631 has closure 632, shown as a zipper. When pocket 631 is unsnapped from protective bag 630, it can be used on its own.

FIG. 8 shows pocket 650 having a configurable size. Width pleat 605 of protective bag 600 is shown in closed form. Height pleat 606 of protective bag 600 is shown in closed form.

Straps 652, 654, 656, 658 function in similar manner as strap 91 of FIGS. 3A-3C, and will. Straps 652, 654, 656, 658 are mated with loop fasteners (not shown) located on the central part of pocket 650, to keep pocket 650 in its most compact form, forming pleats 641, 641, 643, 644. In other embodiments, fasteners other than straps are used, as generally discussed above.

Snaps 662, 664, 666, 668 are located in the vertices of pocket 650, and serve to affix the corners of pocket 650 to a front or back panel of protective bag 600. Stitching 682, 684, 686, 687, 688, 689 further affixes the corners of pocket 650 to the panel of protective bag 600.

Removable fasteners 672, 674, 676, 678, located at approximately the midpoints of the sides of pocket 650 serve to further affix pocket 650 to the panel of protective bag 600. In this embodiment, removable fasteners 672, 674, 676, 678 are hook and loop fasteners, with the hook part on the backside of pocket 650, and the loop part on the pleats formed in the panel of protective bag 600.

Since there are openings along the edges of pocket 650, pocket 650 is not suitable for small items. Pocket 650 serves to hold large electronic devices, paper, notebooks or the like.

When protective bag 600 is adjusted from its compact form to its expanded form (please refer to the discussion of FIGS. 3A-3C above), removable fasteners 672, 674, 676, 678 are separated, and pocket 650 is also adjusted from its compact form to its expanded form. Alternately, protective bag 600 may be maintained in its compact form, and pocket 650 set to its expanded form, to hold thicker items.

Similarly, when protective bag 500 is adjusted from its expanded form to its compact form, pocket 650 is adjusted from its expanded form to its compact form, and removable fasteners 672, 674, 676, 678 are fastened.

Because pleats 641, 642 are offset from pleat 605, and pleat 643, 644 are offset from pleat 606, the bulk of protective bag is reduced.

When not in use, the protective bag can be folded and stored in a pouch made of the same or different material, and conveniently carried in a handbag.

Although illustrative embodiments of the present invention, and various modifications thereof, have been described in detail herein with reference to the accompanying drawings, it is to be understood that the invention is not limited to these precise embodiment and the described modifications, and that various changes and further modifications may be effected therein by one skilled in the art without departing from the scope or spirit of the invention as defined in the appended claims.

What is claimed is:

1. A bag having a height, a width and a depth, comprising:
a front panel,
a back panel,
a left panel,
a right panel, and
a base panel,
each of the front, back, left, right and base panels having four edges, an edge of each of the front panel and the back panel connected to an edge of each of the left panel and right panel, an edge of the base panel respectively connected to an edge of each of the front, back, left and right panels, thereby forming a compartment bounded by the front, back, left, right and base panels, each of the front and back panels having a first set of paired connectors along a first dimension, and a second set of paired connectors along a second dimension, the second dimension being perpendicular to the first dimension, each set of paired connectors for forming a pleat along a respective dimension when the paired connectors are connected to each other, whereby the first dimension of the compartment can be changed from a first size to a second size by connecting the first set of paired connectors of the front and back panels, and the second dimension of the compartment can be changed from a starting size to an ending size by connecting the second set of paired connectors of the front and back panels, the sizes of the first and second dimensions of the compartment being independently changeable, the compartment always having all interior angles no more than 90°.

2. The bag of claim 1, further comprising a rim having a perimeter extending along the top of each of the front, back, left and right panels, the length of the rim being configurable.

3. The bag of claim 1, further comprising an upper panel having a first closure, and wherein the left panel has a second closure, so that the orientation of the bag is selectable from a first orientation in which the upper panel serves as the top of the bag, and a second orientation in which the left panel serves as the top of the bag.

4. The bag of claim 1, wherein each of the front and back panels has a third set of paired connectors along the first dimension, and a fourth set of paired connectors along the second dimension, so that the size of the compartment along the first dimension can be changed from the second size to a third size by connecting the third set of paired connectors, and the size of the compartment along the second dimension can be changed from the ending size to an ultimate size by connecting the fourth set of paired connectors, the compartment always having all interior angles no more than 90°.

5. The bag of claim 4, wherein the paired connectors are chosen from snaps, hook and loop fasteners, zippers, magnets, laces, and buttons/buttonholes.

6. The bag of claim 1, further comprising at least one pocket.

7. The bag of claim 6, wherein the pocket is configurable in two dimensions.

8. The bag of claim 1, further comprising a carrier selected from a shoulder strap and a pair of handles.

9. The bag of claim 8, wherein the carrier is removable.

10. The bag of claim 1, wherein the left and right panels form a pleat along the first dimension when the bag is changed from the first size to the second size.

11. The bag of claim 1, wherein the left and right panels each have a third set of paired connectors along a third dimension, the third dimension being orthogonal to each of the first and second dimensions, each set of paired connectors for forming a pleat along a respective dimension when the paired connectors are connected to each other.

12. The bag of claim 11, wherein the paired connectors are chosen from snaps, hook and loop fasteners, zippers, magnets, laces, and buttons/buttonholes.

13. The bag of claim 1, wherein the paired connectors are chosen from snaps, hook and loop fasteners, zippers, magnets, laces, and buttons/buttonholes.

14. The bag of claim 1, wherein the front and back panels are made of a non-rigid material.

15. A bag, comprising:

a front panel having a top edge and a U-shaped edge;

a back panel having a top edge and a U-shaped edge;

each of the front and back panels having a first set of paired connectors along a first dimension, and a second set of paired connectors along a second dimension, the second dimension being perpendicular to the first dimension, each of the first and second set of paired connectors for forming a pleat along a respective dimension when the paired connectors are connected to each other, a depth panel having a rectangular shape, a first edge of the depth panel connected to the U-shaped edge of the front panel, a second edge of the depth panel connected to the U-shaped edge of the back panel, the first and second edges of the depth panel being on opposing sides, thereby forming a compartment bounded by the front, back, left and depth panels, the depth panel having a left closure along its left side and a right closure along its right side, the left closure forming a left opening in the depth panel when opened, and the right closure forming a right opening in the depth panel when opened, a left extension pocket connected to the left opening in the depth panel;

a right extension pocket connected to the right opening in the depth panel;

wherein the bag is adjustable between a first state and a second state, the first state in which the silhouette of the bag is determined by the U-shaped edges of the front and back panels when the left and right closures are closed, the second state in which the silhouette of the bag is determined by the left and right extension pockets respectively pulled through the left and right openings when the left and right closures are opened, and the first dimension of the compartment can be changed from a first size to a second size by connecting the first set of paired connectors of the front and back panels, and the second dimension of the compartment can be changed from a starting size to an ending size by connecting the second set of paired connectors of the front and back panels, the sizes of the first and second dimensions of the compartment being independently changeable.

16. The bag of claim 15, further comprising a rim having a perimeter extending along the top of each of the front and back panels, the length of the rim being configurable.

17. The bag of claim 15, further comprising a carrier selected from a shoulder strap and a pair of handles.

18. The bag of claim 15, wherein each of the left and right closures is a zipper.

* * * * *